US009009907B2

(12) United States Patent
Matola et al.

(10) Patent No.: US 9,009,907 B2
(45) Date of Patent: Apr. 21, 2015

(54) FLAT MOP FRAME

(75) Inventors: Jesse Andrew Matola, Winchester, VA (US); Robert J. Tokash, Stephens City, VA (US)

(73) Assignee: Rubbermaid Commercial Products, LLC, Winchester, VA (US)

( * ) Notice: Subject to any disclaimer, the term of this patent is extended or adjusted under 35 U.S.C. 154(b) by 548 days.

(21) Appl. No.: 13/290,288

(22) Filed: Nov. 7, 2011

(65) Prior Publication Data

US 2012/0110814 A1 May 10, 2012

Related U.S. Application Data

(60) Provisional application No. 61/411,175, filed on Nov. 8, 2010.

(51) Int. Cl.

| | |
|---|---|
| ***A47L 13/258*** | (2006.01) |
| ***A47L 13/256*** | (2006.01) |
| *A47L 13/254* | (2006.01) |

(52) U.S. Cl.

CPC ..... *A47L 13/258* (2013.01); *A47L 13/256* (2013.01); *A47L 13/254* (2013.01)

USPC ..... 15/147.2

(58) Field of Classification Search

USPC ..... 15/147.1, 147.2, 150, 228, 229.6–229.9

See application file for complete search history.

(56) References Cited

U.S. PATENT DOCUMENTS

| | | | |
|---|---|---|---|
| 790,030 | A | 5/1905 | Crawford |
| 2,255,091 | A | 9/1941 | Vaughn |
| 2,794,997 | A | 6/1957 | Channell |
| 3,045,252 | A | 7/1962 | Sorrells |
| 3,441,973 | A | 5/1969 | Turk |
| 4,680,826 | A | 7/1987 | Schunter |
| 4,798,307 | A | 1/1989 | Evrard |
| 4,845,800 | A | 7/1989 | Pederson et al. |
| 5,245,724 | A | 9/1993 | Sacks |
| 5,548,865 | A | 8/1996 | Pagani |
| 5,864,914 | A | 2/1999 | Salmon |
| 6,026,530 | A | 2/2000 | Camp, Jr. |
| 6,389,638 | B1 | 5/2002 | Dickinson et al. |

(Continued)

FOREIGN PATENT DOCUMENTS

| | | | |
|---|---|---|---|
| CN | 200984158 | Y | 12/2007 |
| DE | 4403550 | * | 9/1995 |

(Continued)

OTHER PUBLICATIONS

International Searching Authority, International Search Report issued for International application No. PCT/US2011/059565, Mar. 4, 2012.

(Continued)

*Primary Examiner* — Mark Spisich

(74) *Attorney, Agent, or Firm* — Dennis J. Williamson; Moore & Van Allen PLLC

(57) ABSTRACT

The mop frame comprises a first plate pivotably connected to a handle attachment at a first pivot. A second plate is pivotably connected to the first plate at a second pivot such that it is movable between a first position where the second plate is substantially coplanar with the first plate and a second position where the first plate is substantially parallel to the second plate and is disposed on top of the second plate. A latch secures the first plate to the second plate when the second plate is in the second position.

18 Claims, 10 Drawing Sheets

(56) References Cited

U.S. PATENT DOCUMENTS

| | | | |
|---|---|---|---|
| 6,540,168 | B1 | 4/2003 | Archer et al. |
| 6,662,401 | B2 | 12/2003 | Zorzo |
| 2002/0092113 | A1 | 7/2002 | Cann |
| 2005/0076465 | A1 | 4/2005 | Rousey |
| 2007/0006413 | A1 | 1/2007 | Lee |
| 2008/0302715 | A1 | 12/2008 | Venville |
| 2009/0094769 | A1 | 4/2009 | Wilson |
| 2011/0100395 | A1 | 5/2011 | Van Landingham, Jr. et al. |

FOREIGN PATENT DOCUMENTS

| | | | | |
|---|---|---|---|---|
| DE | 19631617 | | * | 2/1997 |
| EP | 0757903 | A2 | | 2/1997 |
| JP | 10-286208 | | * | 10/1998 |
| WO | 2006/002652 | | * | 1/2006 |
| WO | 2006002653 | A1 | | 1/2006 |
| WO | 2006094918 | A1 | | 9/2006 |
| WO | 2006002654 | A1 | | 12/2006 |
| WO | 2008106780 | A1 | | 9/2008 |

OTHER PUBLICATIONS

International Searching Authority, Written Opinion issued for International application No. PCT/US2011/059565, Mar. 4, 2012.
Co-pending U.S. Appl. No. 29/405,928, filed Nov. 8, 2011.
U.S. Patent and Trademark Office, Office Action issued in U.S. Appl. No. 29/405,928, Apr. 11, 2012.
Co-pending U.S. Appl. No. 29/405,784, filed Nov. 7, 2011.
Rubbermaid Commercial Products LLC, Chinese Application No. 201180053868.2, Office Action, Dec. 31, 2014.

* cited by examiner

FLAT MOP FRAME

This application claims benefit of priority under 35 U.S.C. §119(e) to the filing date of to U.S. Provisional Application No. 61/411,175, as filed on Nov. 8, 2010, which is incorporated herein by reference in its entirety.

BACKGROUND

Flat mops typically comprise a frame on which a fabric mop pad is supported. The frame is shaped such that the mop pad is supported in a flat configuration where the cleaning surface of the mop pad is disposed in a substantially flat plane. The frame is typically connected to an elongated handle at a pivot connection such that the handle can be manipulated by the user to move the cleaning surface of the mop pad over a floor or other surface.

SUMMARY OF THE INVENTION

The mop frame comprises a first plate pivotably connected to a handle attachment at a first pivot. A second plate is pivotably connected to the first plate at a second pivot such that it is movable between a first position where the second plate is substantially coplanar with the first plate and a second position where the first plate is substantially parallel to the second plate and is disposed on top of the second plate. A latch secures the first plate to the second plate when the second plate is in the second position.

The handle attachment may comprise a quick release attachment for releasably attaching the handle attachment to a handle. The axis of rotation of the first pivot may be parallel to the axis of rotation of the second pivot. The handle attachment may be pivotably secured to the first plate at a third pivot where the axis of rotation of the first pivot is perpendicular to the axis of rotation of the third pivot. The first plate and second plate may comprise a planar rigid member. A first support may be located on the inside surface of the first plate that extends for substantially the width of the first plate where an outer surface of the first plate forms a support and backing surface for a first side of a mop pad and an outer surface of the second plate and an outer surface of the first support form a support and backing surface for a second side of the mop pad. A second support may be located on the inside surface of the second plate where the second support maintains the first plate and the second plate in a substantially parallel relationship when the second plate is in the second position. The first plate may comprise a first lobe that is configured to engage a first pocket on a mop pad and the second plate may comprise a second lobe that is configured to engage a second pocket on the mop pad. The latch may be a spring loaded latch on one of the first plate and the second plate that releasably engages a latch plate on the other of the first plate and the second plate to lock the first plate to the second plate when the second plate is in the second position. The latch may further comprise a push button for moving the latch to an unlocked position to allow the second plate to move away from the first plate to the first position.

A method of using a mop frame and mop pad where the mop pad comprises a first side comprising a first pocket and a second pocket and the mop frame comprises a first plate pivotably connected to a second plate where the first plate has a first lobe for engaging the first pocket and the second plate has a second lobe for engaging the second pocket comprises placing the mop frame on the first side of the mop pad with the first lobe engaging the first pocket; rotating the first plate toward the second plate to insert the second lobe in the second pocket; and locking the first plate to the second plate.

The method may comprise wrapping the mop pad around the first plate and the second plate. The step of rotating the first plate toward the second plate may comprise manipulating a handle attachment that is pivotably secured to the first plate. The step of placing the mop frame on the first side of the mop pad may comprise placing both the first plate and the second plate on the first side of the mop pad. The step of locking the first plate to the second plate may comprise pressing on the handle attachment to push the first plate toward the second plate. The method may further comprise unlocking the first plate from the second plate and lifting the second plate to remove the mop pad from the mop frame under the force of gravity.

DETAILED DESCRIPTION OF PREFERRED EMBODIMENTS OF THE INVENTION

Figure 1:
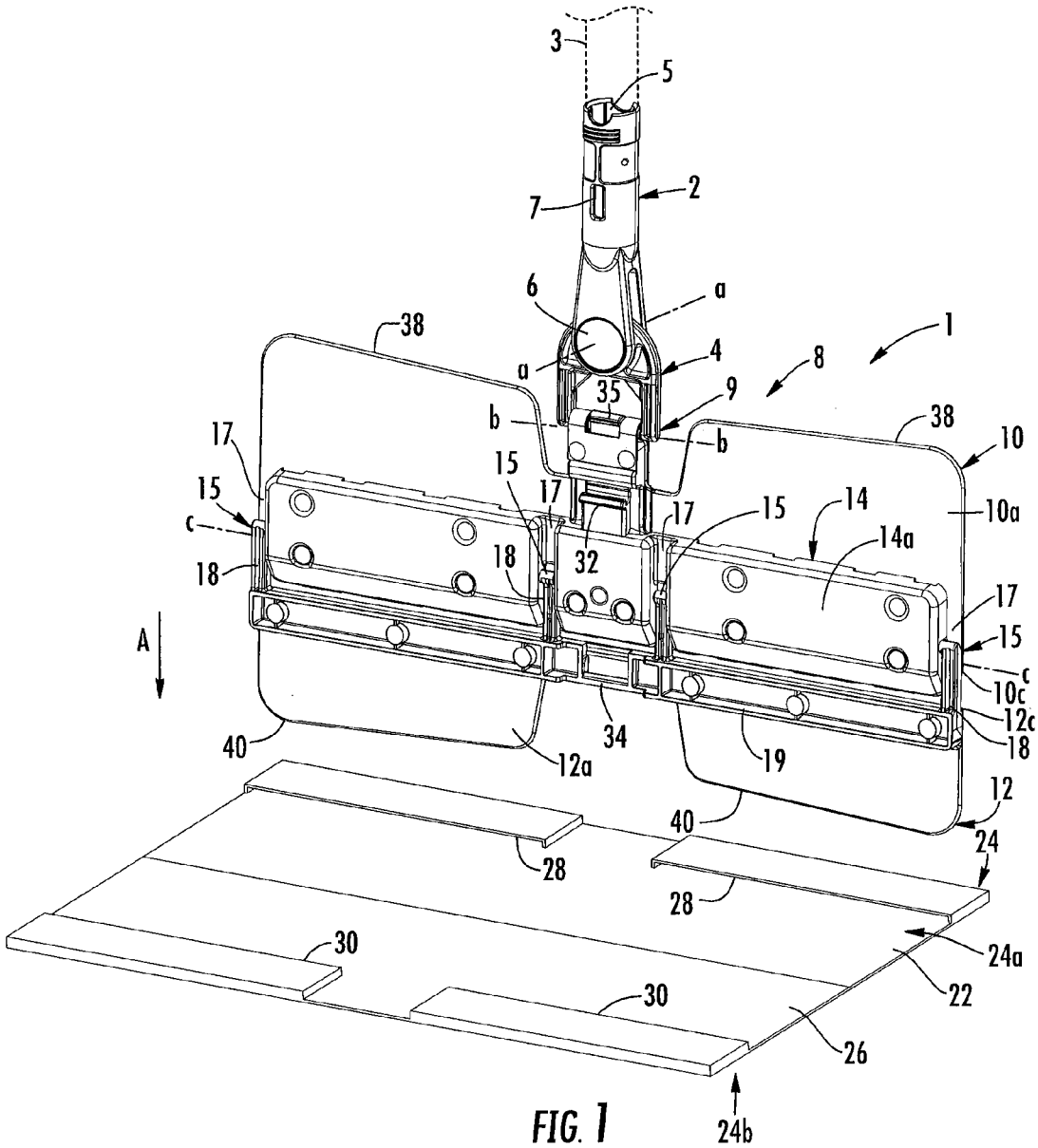
FIG. 1 is a perspective view of an embodiment of a mop frame and mop pad.

One embodiment of the mop frame 1 is shown in the drawings comprising a handle attachment 2 that may be secured to an elongated mop handle 3 that allows the user to use the mop from a standing position. The handle attachment 2 defines a receptacle 5 configured to receive one end of the mop handle 3. The handle attachment 2 may be provided with a quick release attachment for releasably attaching the mop handle 3 to the handle attachment 2. In the illustrated embodiment the handle attachment 2 is provided with an aperture 7 that receives a spring loaded push button on the mop handle. The handle attachment may comprise other quick release attachment mechanisms or coupling mechanisms such as screw threads that mate with screw threads formed on the handle. The handle attachment 2 may also be permanently attached to the mop handle 3.

Figure 8:
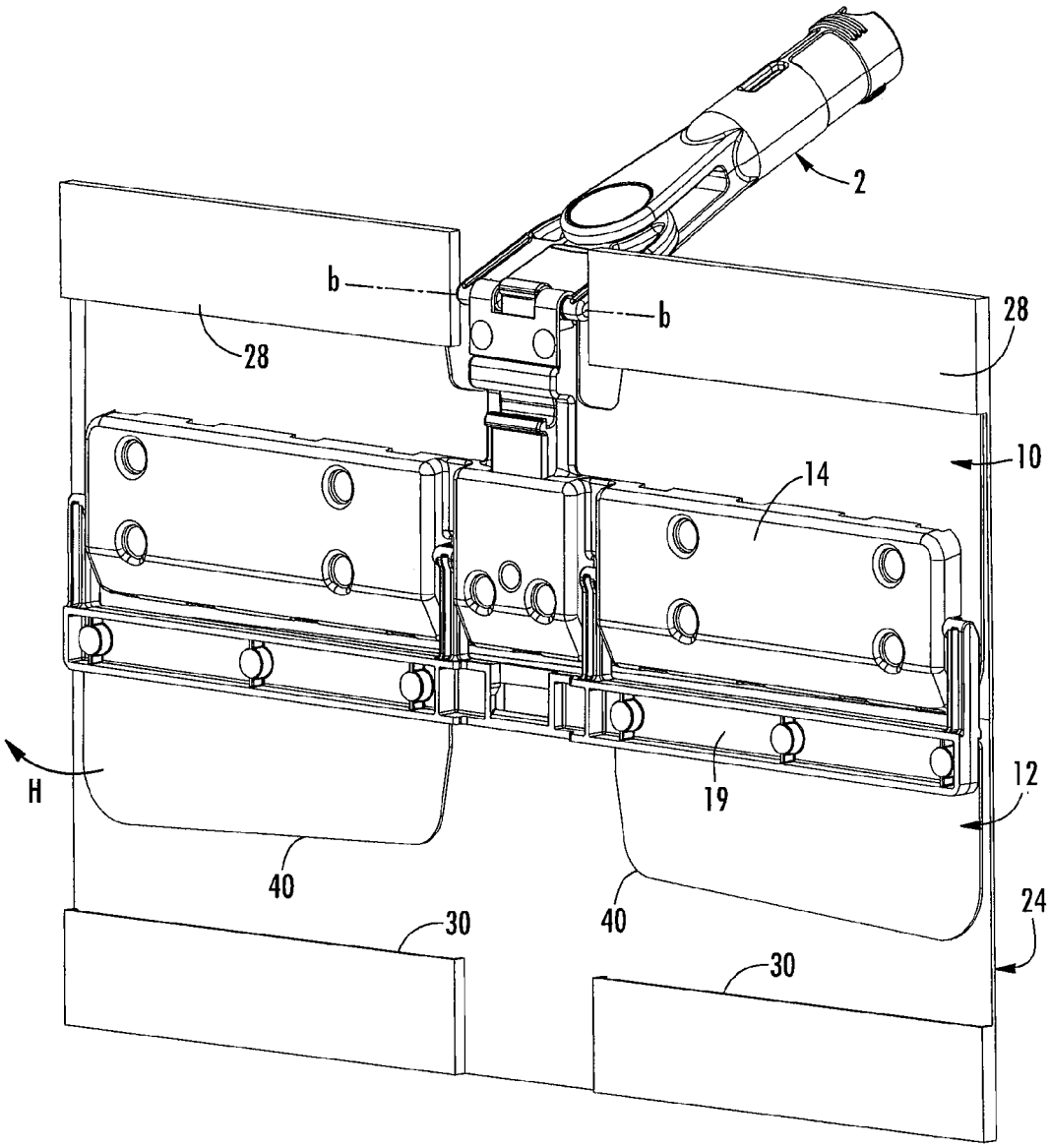
Figure 9:
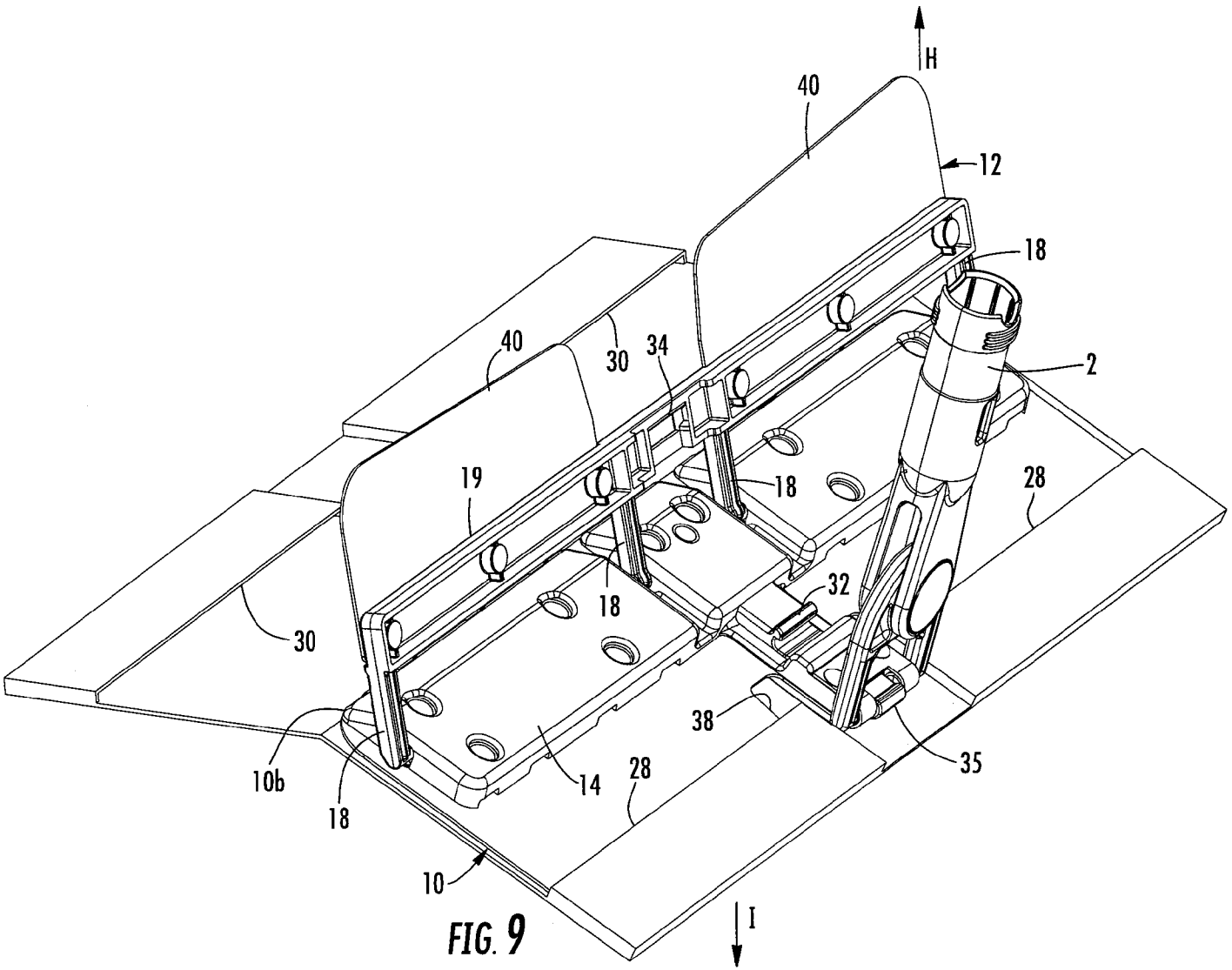

The handle attachment 2 is secured to a yoke 4 at a first pivot 6 where the yoke 4 may pivot relative to the handle attachment 2 about axis a-a. The first pivot may comprise a pivot pin on the handle attachment 2 that is rotatably supported in a bearing in yoke 4 or other similar structure. The yoke 4 is connected to a mop frame assembly 8 at a second pivot 9 where the mop frame assembly 8 may pivot relative to the yoke 4 about axis b-b. The second pivot 9 may comprise a pivot pin on the yoke 4 that is rotatably supported in a bearing in frame assembly 8 or other similar structure. The axis of rotation of the second pivot b-b may be arranged perpendicular to the axis of rotation of the first pivot a-a such that the mop may be circulated in a FIG. 8 pattern by the user. The mop frame assembly 8 comprises a top plate 10 that is pivotably connected to a bottom plate 12 where the axis of rotation c-c between the top plate 10 and bottom plate 12 is parallel to the axis of rotation b-b of the second pivot 9.

The top plate 10 may comprise a planar member made of relatively rigid material such as molded plastic or metal. The outside surface 10*b* of top plate 10 defines a flat surface that backs and supports a first section 22 of the mop pad 24 during use. A support 14 is secured to the inside surface 10*a* of the top plate 10 and extends for substantially the width of the plate 10. The support 14 extends from surface 10*a* a distance that defines the spacing between the plates 10 and 12 in the folded use position and comprises a flat outside surface 14*a* that is disposed parallel to outside surface 10*b* of plate 10. The support 14 defines recesses 17 that receive the legs 18 of the bottom plate 12. The support 14 is positioned on the top plate 10 such that it is disposed along the bottom edge 10*c* of the plate 10 and extends for a portion of the height of the plate 10. The support 14 operates to secure the bottom plate 12 to the top plate 10 and backs and supports a portion of the second section 26 of the mop pad 24 during use as will hereinafter be described.

Figure 10:
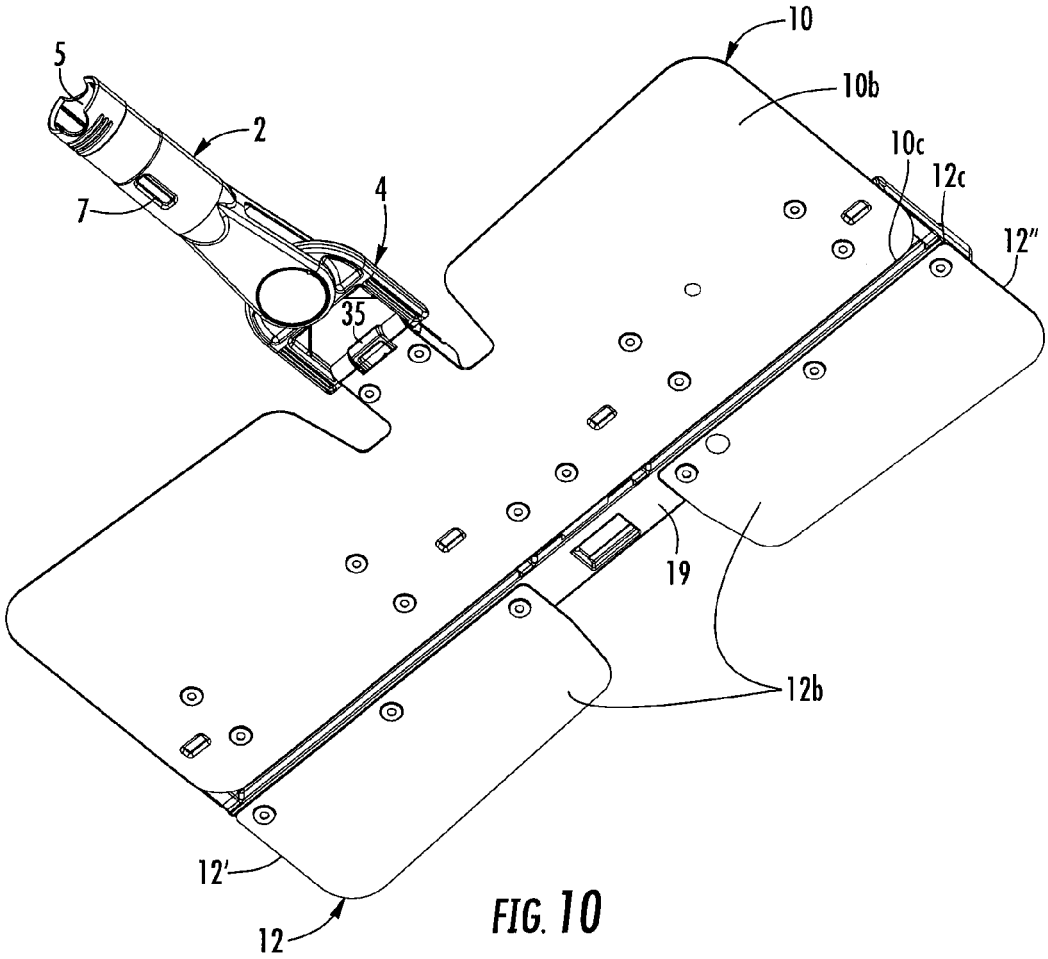
FIG. 10 is a view illustrating the opposite side of the mop frame from that shown in FIG. 1.

The bottom plate 12 comprises a planar support made of relatively rigid material such as molded plastic or metal. A support 19 is secured to the inside surface 12*a* of bottom plate 12 and extends for substantially the width of the plate. In the illustrated embodiment the bottom plate 12 is formed of two sections 12' and 12" joined by support 19, as shown in FIG. 10. The two sections 12' and 12" are referred to collectively as bottom plate 12 it is to be understood that the bottom plate 12 may be formed of a single member rather than the two sections as illustrated. The support 19 is positioned on the bottom plate 12 such that it is disposed along the upper edge 12*c* of the plate 12 adjacent to the bottom edge 10*c* of top plate 10 and extends for a portion of the height of the plate 12. The support 19 comprises a plurality of legs 18 that extend to the support 14 and are located in the recesses 17. The legs 18 are connected to the support 14 at pivots 15 such that the bottom plate 12 may pivot relative to the top plate 10 approximately 180 degrees about axis c-c. Pivots 15 may comprise pins on the legs 18 that are received in mating bearings or apertures formed on the support 14 or other similar structure. The outside surface 12*b* of bottom plate 12 defines a flat surface that backs and supports a portion of the second section 26 of the mop pad 24 during use.

Figure 6:
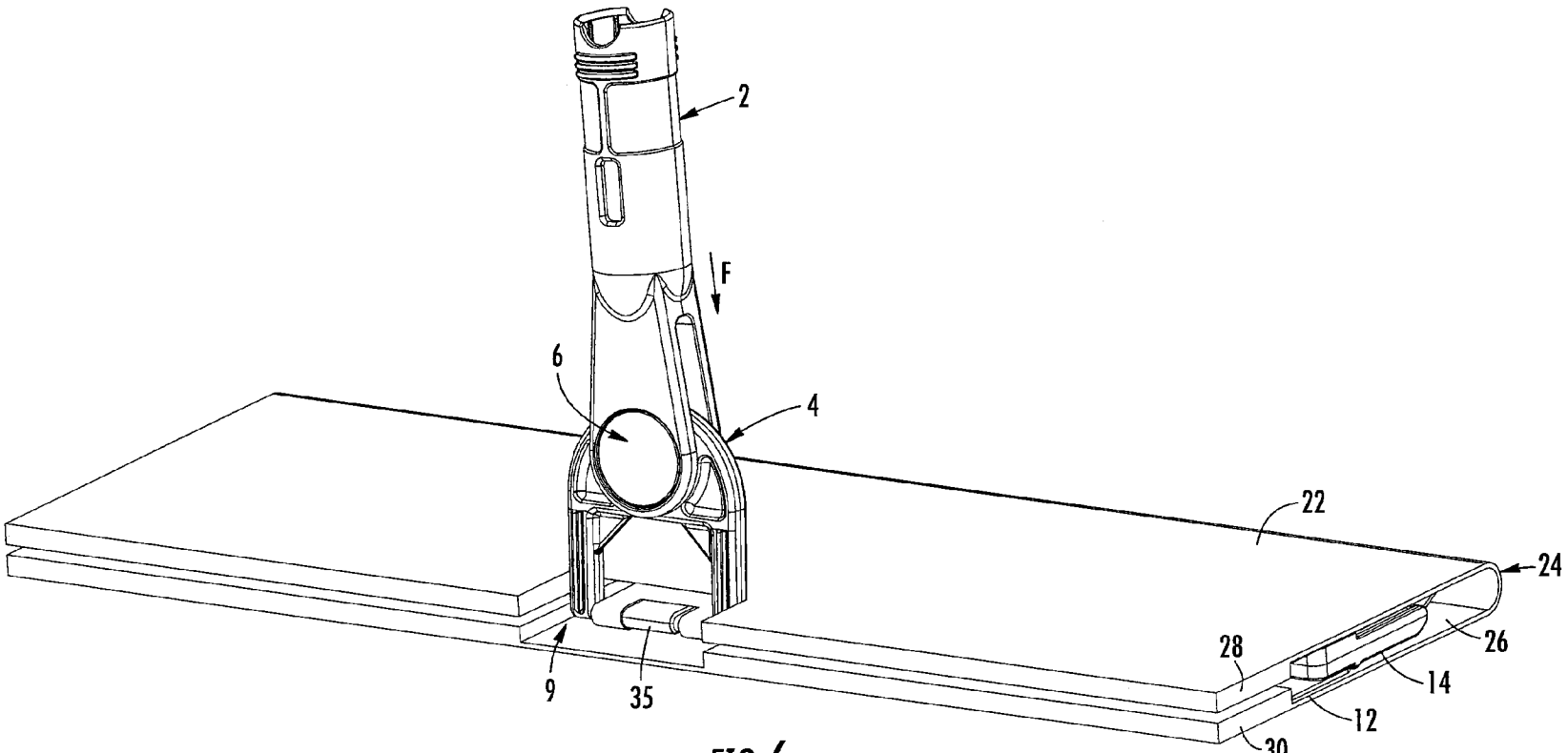

The plates 10 and 12 may occupy a first unfolded position as shown in FIG. 1 where the plates are disposed substantially parallel to one another and in approximately the same plane and the folded, use position of FIG. 6 where the plates are substantially parallel to one another and are positioned on top of one another such that the bottom plate 12 is disposed opposite to the top plate 10. When the plates 10 and 12 occupy the folded, use position the support 19 is positioned closely adjacent to the support 14 such that a continuous backing and support surface for the second section 26 of mop pad 24 is created by the outside surface 12*b* of plate 12 and the outside surface 14*a* of support 14. The legs 18 are arranged such that when the bottom plate 12 is rotated to the folded position over the top plate 10 the legs are positioned in recesses 17 and support 19 is positioned adjacent to support 14 and rests against surface 10*a* of plate 10. The support 19 maintains the plates 10 and 12 in a substantially parallel relationship when the frame assembly 8 is in the folded position. In the folded position the outer surface 10*b* of plate 10 forms the support and backing for section 22 of the mop pad 24 and the outer surface 12*b* of plate 12 and the outer surface 14*a* of support 14 are disposed substantially coplanar and form the support and backing for section 26 of the mop pad 24.

The top plate 10 is configured to have protruding lobes 38 that engage back pockets 28 formed on the back edge of mop pad 24. The bottom plate 12 is configured to have protruding front lobes 40 that engage front pockets 30 formed on the front edge of the mop pad 24. While two front pockets 30 and two mating lobes 40 and two back pockets 28 and two mating lobes 38 are shown a greater or fewer number of lobes and pockets may be used. The plate 10, including lobes 38 and support 14 may be formed of a unitary, one piece member or these elements may comprise multiple members secured to one another to create the plate structure. Likewise, the plate 12, including lobes 40 and support 19 may be formed of a unitary, one piece member or these elements may comprise multiple members secured to one another to create the plate structure. The supports 14 and 19 do not extend to the lobes 38 and 40 such that a space is created between the plates 10 and 12 in the area of lobes 38 and 40 to receive the pockets 28 and 30 of the mop pad 24.

The mop pad 24 comprises a top side 24*a* and a bottom side 24*b*. In use the bottom side 24*b* is exposed and acts as the cleaning surface of the mop pad. The top side 24*a* comprises the pockets and faces the frame assembly 8. The mop pad 24 is divided into a first section 22 and a second section 26 where the first section 22 covers plate 10 and the second section 26 covers plate 12. In actual use the sections 22 and 26 may be identical. The mop pad 24 is dimensioned and shaped to have approximately the same surface area and shape as plates 10 and 12.

A spring loaded latch 32 is positioned on top plate 10 that releasably engages a latch plate 34 on bottom plate 12 to lock the top plate 10 to the bottom plate 12 in the folded, use position. The latch 32 is biased to the locked position by the spring. A push button 35 is provided that operatively engages latch 32 and that may be depressed by the user to move latch 32 to the unlocked position against the bias of the spring to release latch 32 from latch plate 34 and to allow the bottom plate 12 to pivot away from the top plate 10 during removal and replacement of the mop pad.

Figure 2:
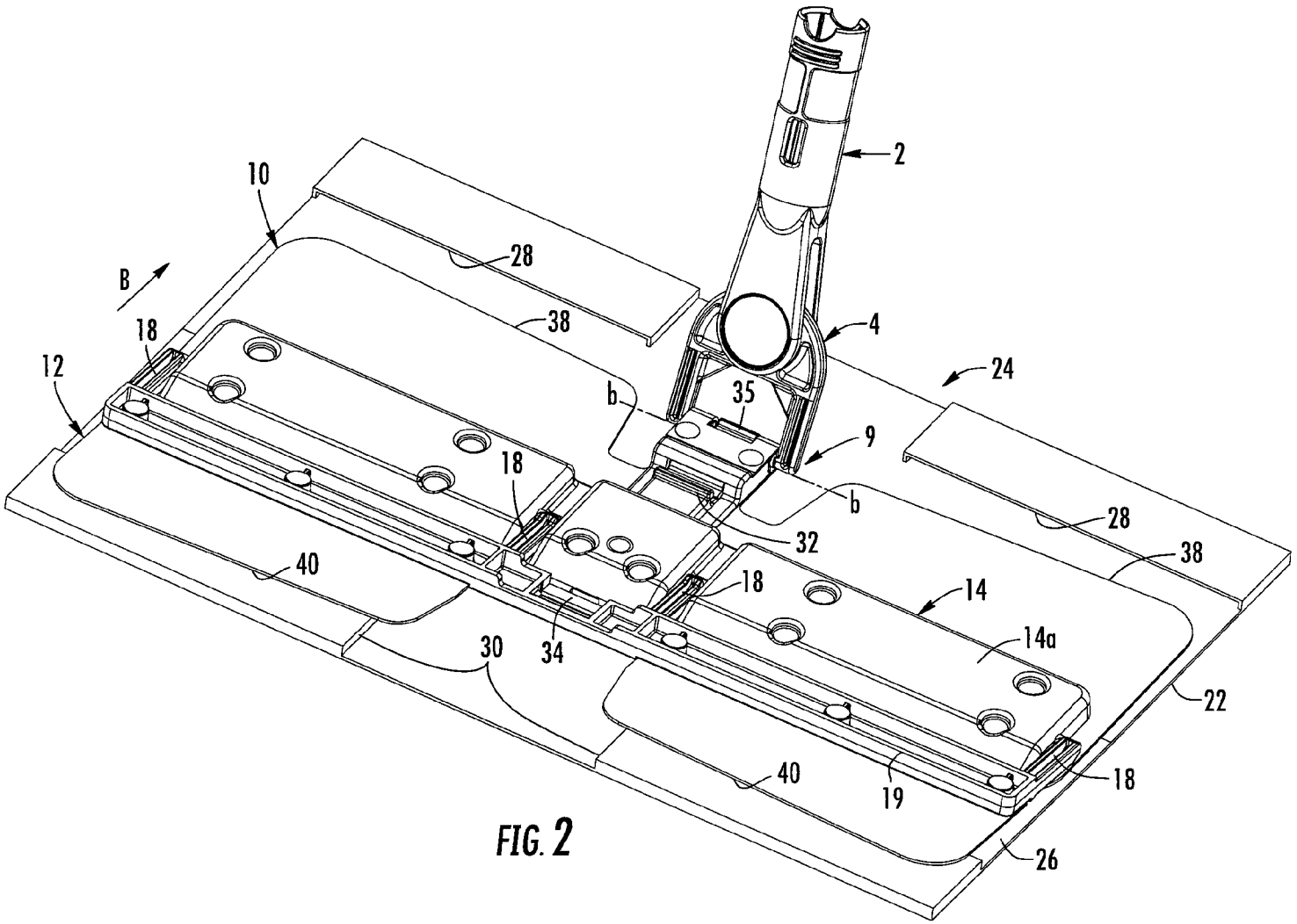
FIGS. 2 through 9 are views similar to FIG. 1 illustrating the method of operating the mop frame.

Referring to FIG. 1, to attach the mop frame 1 to a mop pad 24, the mop pad 24 is placed bottom side 24*b* down on a floor surface with the top side 24*a* and pockets 28 and 30 facing upward. The frame assembly 8 is suspended substantially vertically from pivot 9 in the open, unfolded position above the mop pad 24 with bottom plate 12 facing toward the mop pad 24. The frame 1 is lowered onto the open mop pad 24 as shown by arrow A in FIG. 1. The frame 1 is lowered until the outer surface 10*a* of the top plate 10 and the outer surface 12*a* of bottom plate 12 rest on the inside surface of the mop pad 24 as shown in FIG. 2. The frame assembly 8 lays flat on the mop pad 24 and is positioned with the lobes 38 facing the mop pad pockets 28.

Figure 3:
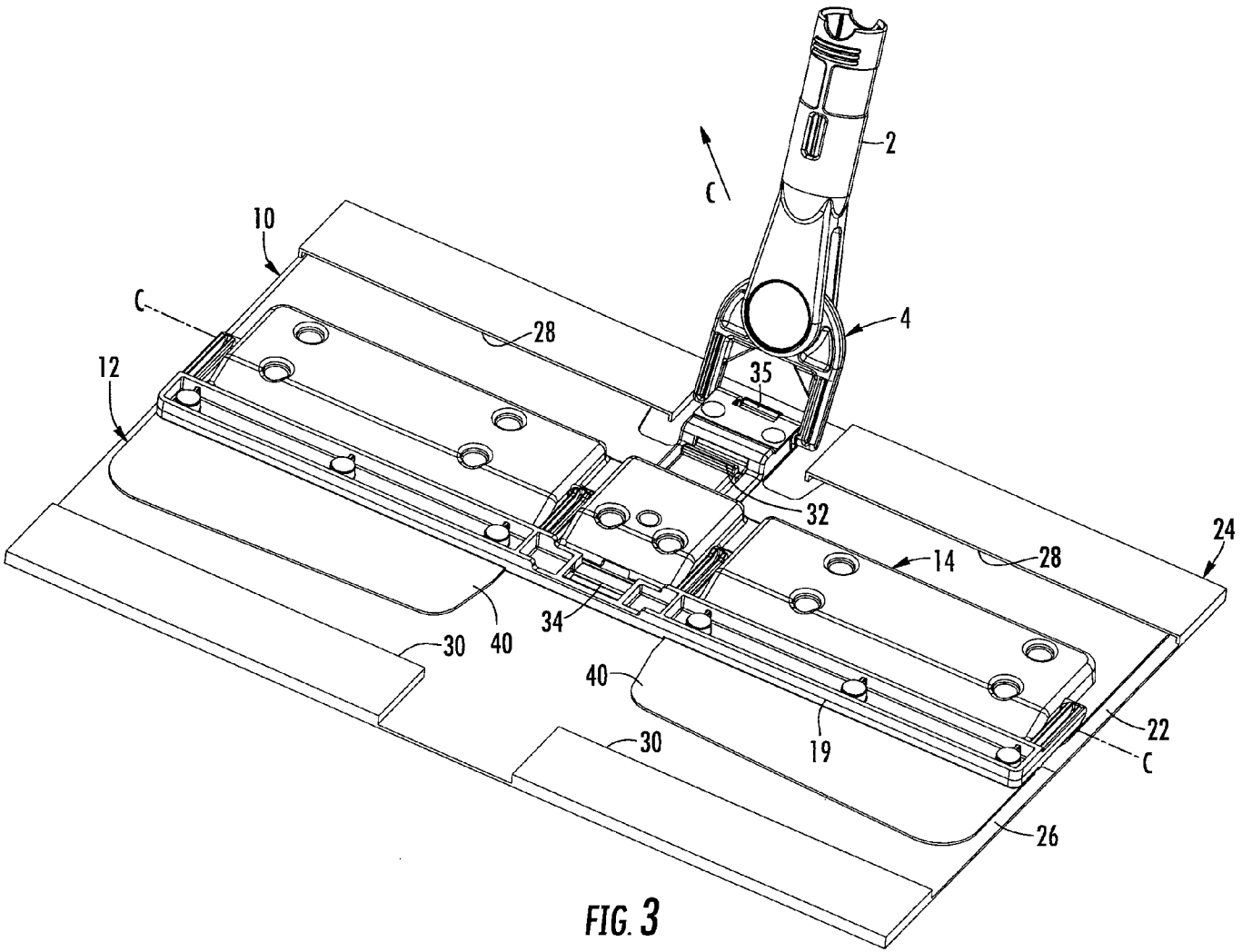

The mop frame 1 is slid backward by the handle attachment 2 in the direction of arrow B, FIG. 2, to slide the two lobes 38 into the corresponding back pockets 28 of the mop pad 24 as shown in FIG. 3.

Figure 4:
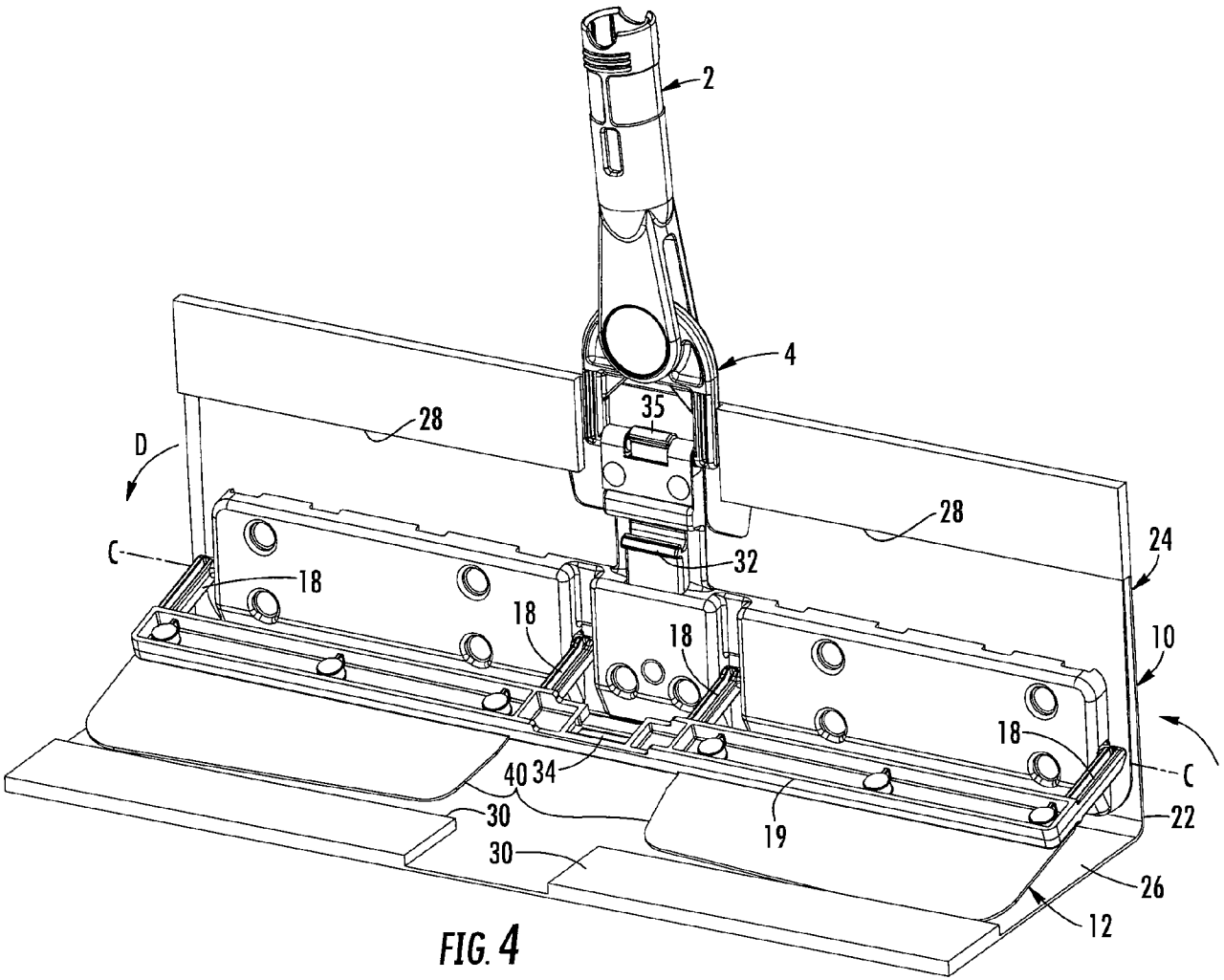

The handle attachment 2 is lifted in an upward motion, as represented by arrow C, to lift the top plate 10 and the first section 22 of the mop pad 24 and to rotate plate 10 about axis c-c relative to plate 12 to the position shown in FIG. 4. As the frame moves to this position, the top plate 10 pivots in a forward motion toward the bottom plate 12 as represented by arrow D. The front edges of the lobes 40 of the bottom plate 12 and section 26 of the mop pad 24 remain supported on the floor or other horizontal surface.

Figure 5:
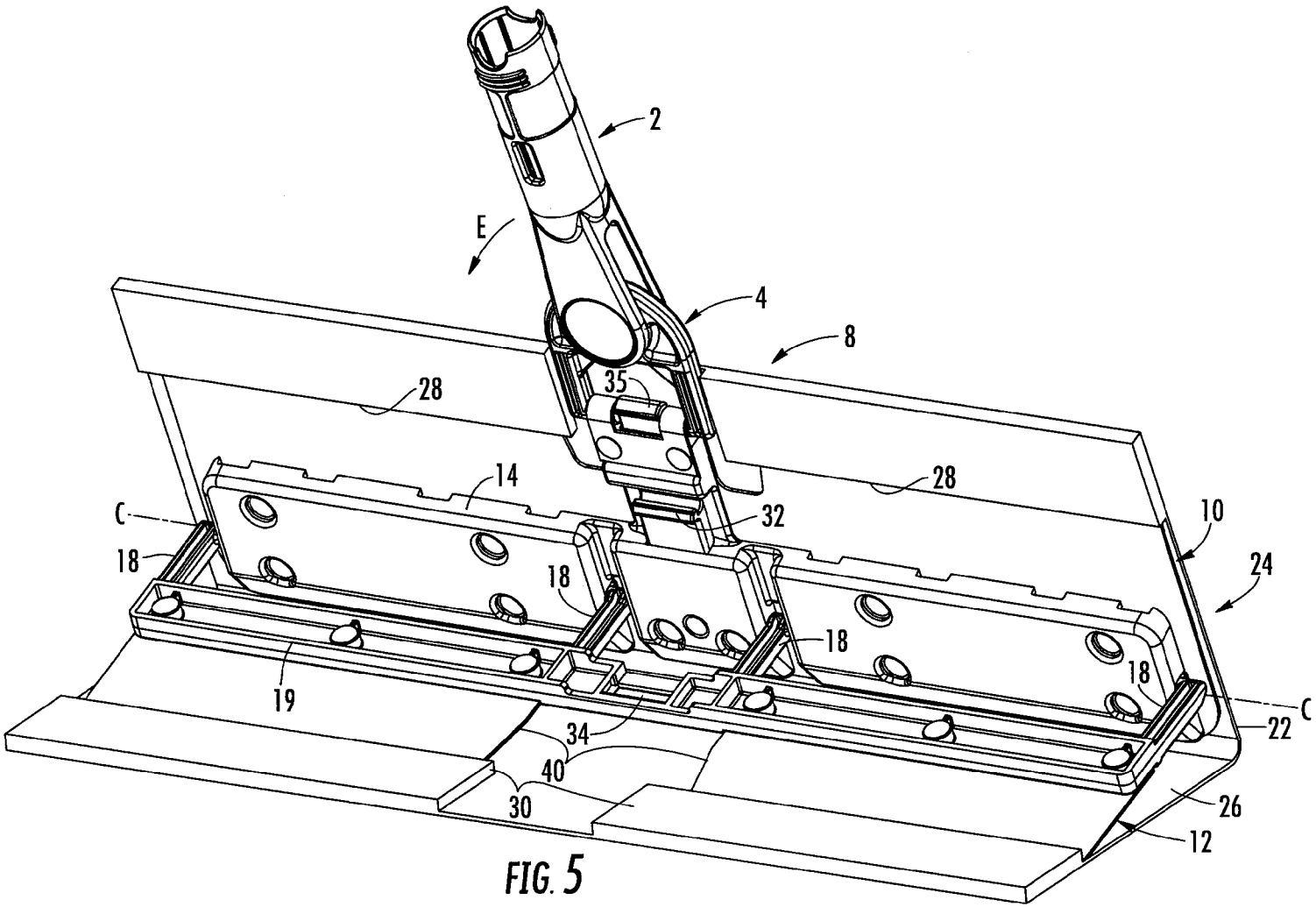

Referring to FIG. 5, the user continues to move the mop handle attachment 2, as represented by arrow E, to rotate the top plate 10 about axis c-c toward the bottom plate 12. As the frame assembly 8 folds the two lobes 40 of the bottom plate 12 slide into the two front pockets 30 of the mop pad 24. The top plate 10 continues to rotate toward bottom plate 12 about axis c-c. The mop pad 24 wraps around the outside of the plates 10 and 12 to surround the outer periphery of frame assembly 8.

The top plate 10 rotates toward bottom plate 12 until the nodes 40 are fully engaged into the pockets 30 of the mop pad 24 and the top plate 10 is arranged parallel to and on top of the bottom plate 12 as shown in FIG. 6. The user pushes downward on the handle attachment 2, as represented by arrow F, to cause the spring loaded latch 32 on the top plate 10 to engage the latch plate 34 of the bottom plate 12 to lock the two plates 10 and 12 of the frame assembly 8 together in the folded use position of FIG. 6. The mop may then be used to clean or otherwise treat a surface such as a floor by wiping the surface with either side of the mop pad 24. The frame assembly 8 is pivoted relative to the handle attachment 2 at pivots 6 and 9 such that the mop can be moved in a FIG. 8 motion or other motion on the floor or other surface.

Figure 7:
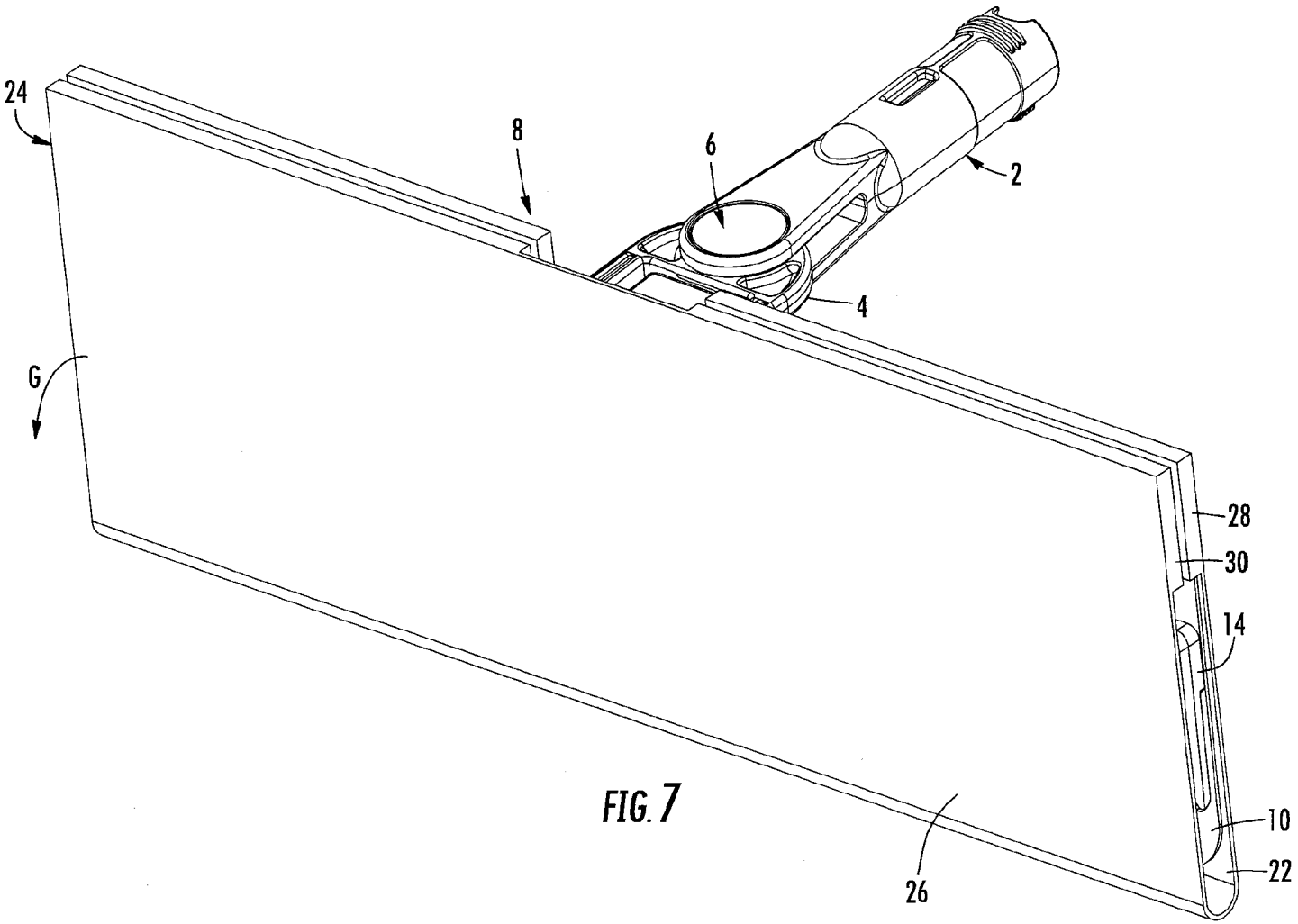

To release mop pad 24 from frame 1, the mop frame assembly 8 is held as shown in FIG. 7 with handle attachment 2 positioned substantially horizontally and frame assembly 8 with mop pad 24 suspended at approximately a 90° angle relative to the handle attachment 2 on pivot axis b-b. The user depresses the spring loaded latch button 35 while holding the handle attachment 2 of the mop frame 1. Depressing the latch button 35 causes the latch 32 to release from latch plate 34 to release the bottom plate 12 from top plate 10. The bottom plate 12 rotates about axis c-c away from top plate 10, as represented by arrow G, to the position of FIG. 8. The lobes 40 of bottom plate 12 are released from the pockets 30 of pad 24 as shown.

The final step of mop pad removal is to hold the frame 1 by the handle attachment 2 and to lift the pivoting bottom plate 12 upward about axis b-b, as represented by arrow H, until the top plate 10 is rotated such that the lobes 38 extend generally downwardly. As the plate rotates the lobes reach an orientation to vertical where the mop pad 24 slides downward and off the top plate 10 under the force of gravity, as represented by arrow I, without the user having to touch the pad 24.

The flat mop frame 1 allows a two-sided mop pad to attach to the frame in a way that minimizes the need for the end user to touch the mop pad when attaching and detaching the mop pad to and from the mop frame. Additionally, the frame is configurable such that once the mop pad is attached to the frame both sides of the mop pad are supported by solid surfaces to facilitate good contact with the floor and the most effective wringing of liquid and dirt from the mop pad. Finally, the design of the frame minimizes the number of components and the cost of manufacture. In one embodiment the mop frame comprises a two-part pivoting mop frame with an off center pivoting plate as shown in the attached drawings which may support a two-sided flat mop pad.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A mop frame comprising:

a first plate pivotably connected to a handle attachment at a first pivot;

a second plate pivotably connected to the first plate at a second pivot such that the second plate is movable between a first position where the second plate is substantially coplanar with the first plate and a second position where the first plate is substantially parallel to the second plate and is disposed on top of the second plate; and a spring loaded latch on one of the first plate and the second plate that releasably engages a latch plate on the other of the first plate and the second plate to lock the first plate to the second plate when the second plate is in the second position and a push button for moving the latch to an unlocked position to allow the second plate to move away from the first plate to the first position.

2. The mop frame of claim 1 wherein the handle attachment comprises a quick release attachment for releasably attaching the handle attachment to a handle.

3. The mop frame of claim 1 where the axis of rotation of the first pivot is parallel to the axis of rotation of the second pivot.

4. The mop frame of claim 1 wherein the handle attachment is pivotably secured to the first plate at a third pivot where the axis of rotation of the first pivot is perpendicular to the axis of rotation of the third pivot.

5. The mop frame of claim 1 wherein the first plate comprises a planar rigid member.

6. The mop frame of claim 1 further comprising a first support on an inside surface of the first plate that extends for substantially the width of the first plate.

7. The mop frame of claim 6 wherein an outside surface of the first plate forms a support and backing surface for a first side of a mop pad and an outside surface of the second plate and an outside surface of the first support form a support and backing surface for a second side of the mop pad.

8. The mop frame of claim 6 further comprising a second support on the inside surface of the second plate.

9. The mop frame of claim 8 wherein the second support maintains the first plate and the second plate in a substantially parallel relationship when the second plate is in the second position.

10. The mop frame of claim 1 wherein the second plate comprises a planar rigid member.

11. The mop frame of claim 1 wherein the first plate comprises a first lobe that is configured to engage a first pocket on a mop pad and the second plate comprises a second lobe that is configured to engage a second pocket on the mop pad.

12. A mop frame comprising:

a first plate comprising a planar rigid member having an inside surface and an outside surface that forms a support and backing surface for a first side of a mop pad, the first plate being pivotably connected to a handle attachment at a first pivot where the first pivot defines a first axis of rotation, the first plate being configured to engage a pocket of a mop pad;

a first support on an inside surface of the first plate that extends for substantially the width of the first plate and comprises a support surface that is substantially parallel to the outside surface;

a second plate comprising a planar rigid member having an inside surface and an outside surface, the first plate being pivotably connected to the second plate at a second pivot where the axis of rotation of the first pivot is parallel to the axis of rotation of the second pivot such that the second plate is movable between a first position where the second plate is substantially coplanar with the first plate and a second position where the first plate is substantially parallel to the second plate and is disposed on top of the second plate, the outside surface of the second plate and the support surface of the support form a support and backing surface for a second side of the mop pad, the second plate being configured to engage a second pocket of the mop pad; and a spring loaded latch on one of the first plate and the second plate that releasably engages a latch plate on the other of the first plate and the second plate to lock the first plate to the second plate when the second plate is in the second position and a push button for moving the latch to an unlocked position to allow the second plate to move away from the first plate to the first position.

13. A method of using a mop frame and mop pad where the mop pad comprises a first side comprising a first pocket and a second pocket and the mop frame comprises a first plate connected to a handle attachment at a first pivot and pivotably connected to a second plate at a second pivot where the first plate has a first lobe for engaging the first pocket and the second plate has a second lobe for engaging the second pocket comprising:

placing the mop frame on the first side of the mop pad with the first lobe engaging the first pocket;

rotating the first plate toward the second plate such that the second plate is rotated about the second pivot between a first position where the second plate is substantially coplanar with the first plate and a second position where the first plate is substantially parallel to the second plate and is disposed on top of the second plate to insert the second lobe in the second pocket; and locking the first plate to the second plate using a spring loaded latch on one of the first plate and the second plate that releasably engages a latch plate on the other of the first plate and the second plate when the second plate is in the second position; and actuating a push button to move the latch to an unlocked position to allow the second plate to move away from the first plate to the first position.

14. The method of claim 13 wherein the step of rotating the first plate toward the second plate comprises wrapping the mop pad around the first plate and the second plate.

15. The method of claim 13 wherein the step of rotating the first plate toward the second plate comprises manipulating the handle attachment.

16. The method of claim 13 wherein the step of placing the mop frame on the first side of the mop pad comprise placing both the first plate and the second plate on the first side of the mop pad.

17. The method of claim 13 wherein the step of locking the first plate to the second plate comprises pressing on the handle attachment to push the first plate toward the second plate.

18. The method of claim 13 further comprising lifting the second plate to remove the mop pad from the mop frame under the force of gravity.

* * * * *